US007267592B1

(12) United States Patent
Ingebritson et al.

(10) Patent No.: US 7,267,592 B1
(45) Date of Patent: Sep. 11, 2007

(54) LATCHING SYSTEM FOR AN OUTBOARD MOTOR COWL

(75) Inventors: Jolayne K. Ingebritson, Fond du Lac, WI (US); Thomas J. Walczak, Oconomowoc, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/491,649

(22) Filed: Jul. 24, 2006

(51) Int. Cl.
*B63H 20/32* (2006.01)

(52) U.S. Cl. ..... 440/77; 123/195 P

(58) Field of Classification Search ..... None
See application file for complete search history.

(56) References Cited

U.S. PATENT DOCUMENTS

| | | | | |
|---|---|---|---|---|
| 4,216,984 A | | 8/1980 | Hofmann et al. | 292/91 |
| 4,348,194 A | | 9/1982 | Walsh | 440/77 |
| 4,600,396 A | | 7/1986 | Crane et al. | 440/77 |
| 4,844,031 A | | 7/1989 | Boda et al. | 123/195 P |
| 4,871,333 A | * | 10/1989 | Curtis et al. | 440/77 |
| 4,875,883 A | | 10/1989 | Slattery | 440/77 |
| 4,927,194 A | | 5/1990 | Wagner | 292/128 |
| 5,120,248 A | | 6/1992 | Daleiden et al. | 440/77 |
| 5,263,884 A | | 11/1993 | Oishi | 440/77 |
| 5,338,236 A | | 8/1994 | Dunham et al. | 440/77 |
| 5,803,777 A | | 9/1998 | Hiraoka | 440/77 |
| 6,080,025 A | | 6/2000 | Isogawa et al. | 440/77 |
| 6,663,450 B1 | | 12/2003 | Walczak et al. | 440/77 |
| 6,991,500 B1 | | 1/2006 | Gulko et al. | 440/77 |

* cited by examiner

*Primary Examiner*—Lars A. Olson
(74) *Attorney, Agent, or Firm*—William D. Lanyi

(57) ABSTRACT

A latch mechanism for a cowl of an outboard motor provides a handle and retaining mechanism for the handle which define a detent position when the handle is in a latching or closed position. A protrusion of the handle rotates in a plane which places it between a roller and a metallic ball when the handle is in a latching position. The metallic ball is shaped to be received in a groove formed in the protrusion in order to define the detent position when the handle is in its latched position.

22 Claims, 6 Drawing Sheets

LATCHING SYSTEM FOR AN OUTBOARD MOTOR COWL

BACKGROUND OF THE INVENTION

1. Field of the Invention

The present invention is generally related to an outboard motor cowl latching system and, more particularly, to a latching mechanism that provides a detent for securing the latch in a closed position when the outboard motor is subjected to impact loads.

2. Description of the Related Art

Those skilled in the art of outboard motors are familiar with many different types of latching systems that are intended to fasten a removable part of the cowl to the outboard motor structure.

U.S. Pat. No. 4,216,984, which issued to Hofmann et al. on Aug. 12, 1980, discloses an automatic locking latch. The latching apparatus catches and locks automatically, but can be released by simply pushing with one hand. Two saw-toothed semi-rigid mating parts are oriented with leading edges and mating teeth facing in a manner so that they interfere slightly when mated. As the parts approach each other, opposing teeth ride on each other and slip past one another until all teeth interlock.

U.S. Pat. No. 4,348,194, which issued to Walsh on Sep. 7, 1982, discloses a cowl for an outboard motor. The cowl includes two bottom cowl members attached together by screws which also mount a latch bracket and a hinge member. The latch bracket supports a latch mechanism which, with the hinge member serves to hold a top cowl member in place.

U.S. Pat. No. 4,600,396, which issued to Crane et al. on Jul. 15, 1986, discloses a cowl latch for outboard motors. It includes a catch mounted on one of the cowl members. A lever is pivotally attached to the other cowl member and a resilient spring member is pivotally attached to the lever. The lever and spring member act to provide an overcenter action on the lever when the latch is closed. The lever includes a shield to conceal the latch assembly.

U.S. Pat. No. 4,844,031, which issued to Boda et al. on Jul. 4, 1989, discloses a rotary latch mechanism for securing cowl sections of an outboard motor. The assembly has an upper cowl section and a lower cowl section and includes various features for improving the structural integrity of the cowl assembly and for providing a water resistant seal at the joint between the cowl sections and at various points of entry of cables and other mechanical devices.

U.S. Pat. No. 4,875,883, which issued to Slattery on Oct. 24, 1989, discloses a latch assembly for releasably securing cowl sections of an outboard motor. The cowl assembly includes an upper cowl section and a lower cowl section and is provided with an improved latch assembly. The latch assembly incorporates a pivotable hook connected to one of the cowl sections which is engageable with a hook engaging member provided on a catch mechanism connected to the other cowl section.

U.S. Pat. No. 4,927,194, which issued to Wagner on May 22, 1990, describes an interlock latch assembly for releasably securing cowl sections of an outboard motor. The mechanism is provided for a latch assembly which releasably secures upper and lower cowl sections of an outboard motor. The interlock mechanism is movable between a locking a position and a release position and is normally disposed in its locking position such as by a coil spring. The interlock mechanism is mounted to the latch handle which is pivotally mounted to one of the cowl sections. A hook is interconnected with the latch handle and is engageable with a catch assembly provided on the other of the cowl sections.

U.S. Pat. No. 5,120,248, which issued to Daleiden et al. on Jun. 9, 1992, discloses a cam-type latching mechanism for securing cowl sections together. The system comprises a catch assembly located at one end of the cowl assembly and a latch mechanism located at the other end of the assembly. The catch assembly includes a catch block mounted to one of the cowl sections with a catch slot formed in the catch block. A roller member is mounted on the other of the cowl sections for engaging the catch slot. The catch slot is formed so as to provide an end wall against which the roller is maintained when the cowl sections are secured together with the material of the catch block engaging the roller member to prevent relative vertical movement between the cowl sections.

U.S. Pat. No. 5,263,884, which issued to Oishi on Nov. 23, 1993, describes a latch for a cowling of an outboard engine. A latch assembly for releasably securing a cowling of a marine propulsion engine comprises a front latch mechanism which is interconnected with at least one rear latch mechanism by a wire cable having a slack adjustor along its length. In a preferred embodiment, a single front latch mechanism and two rear latch mechanisms are linked by the wire cable to an operating lever so that movement of the operating lever causes all of the latches to be disengaged simultaneously.

U.S. Pat. No. 5,338,236, which issued to Dunham et al. on Aug. 16, 1994, describes a latch mechanism for an outboard motor cowl assembly. The cowling of the outboard motor comprises a first cover member including an outer surface having therein a recess, a second cover member mating with the first member, and a selectively engageable latch mechanism for securing the second member to the first member. The latch mechanism includes a latch handle which is supported by the first member which is movable in a first direction between a flush position wherein the latch handle is in the recess and is flush with the remainder of the outer surface and a non-flush position wherein the latch handle extends from the recess and which is movable in a second direction to engage and disengage the latch mechanism.

U.S. Pat. No. 5,803,777, which issued to Hiraoka on Sep. 8, 1998, describes a latch for outboard motor protective cowling. An assembly is provided for engaging and disengaging an upper cover portion and lower tray portion of a cowling of an outboard engine. The lower tray portion includes a recess in which part of the latching assembly is located. The latching assembly includes a shaft mounted to the lower tray portion. A latch is rotatably secured to the shaft and movable between an engaged and disengaged position. The latch is disposed within the recess when engaged so that it is flush with the exterior of the cowling.

U.S. Pat. No. 6,080,025, which issued to Isogawa et al. on Jun. 27, 2000, describes a cowling latch for an outboard motor. The outboard motor has an upper cowling having a lower surface and a lower cowling having an upper surface. The cowling latch comprises a first latching member connected to the upper cowling and a second latching member connected to the lower cowling. The second latching member is movable between a first position in which it engages the first latching member for connecting the upper and lower cowlings and a second position in which it does not engage the first latching member.

U.S. Pat. No. 6,663,450, which issued to Walczak et al. on Dec. 16, 2003, discloses an integral cowl latching mecha nism for an outboard motor. It comprises a base portion that is formed as an integral part of the cowl structure itself. This integral base portion, which is shaped as one or more bosses, eliminates the need for additional brackets and fasteners to attach the latching mechanism to the cowl structure. The boss portion, which is an integral part of the cowl, is shaped to receive a pivot member and a latch to complete the structure of the latching mechanism. A latch pin, which is attached to another component, is shaped to be received through a hole in the boss portion to allow the latch to captivate the latch pin when the latch is in the latching position. This attaches the two cowl members, or cover members, to each other.

U.S. Pat. No. 6,991,500, which issued to Gulko et al. on January 31, 2006, discloses a cowl latching mechanism for an outboard motor. A latching system is provided which facilitates the installation of a removable cowl with respect to a stationary cowl structure and allows these components to be locked together as a result of a simple downward movement in a vertical direction of the removable cowl with respect to the stationary structure. Removal of the removable cowl is also facilitated by allowing these components to be disengaged from each other as a result of a rotation of the removable cowl relative to the stationary cowl structure after a manually operable latch is released.

The patents described above are hereby expressly incorporated by reference in the description of the present invention.

SUMMARY OF THE INVENTION

A latch mechanism for a cowl of an outboard motor, made in accordance with a preferred embodiment of the present invention, comprises a handle which is attachable to a first part of a cowl assembly and a retaining mechanism which is attachable to a second part of the cowl assembly. The handle is rotatable about a first axis between first and second positions. The handle has a protrusion extending from the handle and rotatable about the first axis. The protrusion of the handle is movable into contact with the retaining mechanism in response to rotation of the protrusion about the first axis. The retaining mechanism is configured to exert a force on the protrusion in a direction which is generally parallel to the first axis. The handle and the retaining mechanism are configured to define the second position as a detent position of the handle. The second position is a locking position which retains the second part of the cowl assembly in a fixed position attached to the first part of the cowl assembly.

In a particularly preferred embodiment of the present invention, it further comprises a groove formed in the handle. The groove is movable within a first plane in response to rotation of the handle about the first axis. The present invention, in a preferred embodiment, further comprises first and second locking members attached to the retaining mechanism. The first locking member comprises a roller which is rotatably attached to the retaining mechanism. The roller is rotatably attached for rotation about a second axis which is generally perpendicular to the first axis and parallel to the first plane. The second locking mechanism comprises a rounded component which is shaped to be received in the groove formed in the protrusion. The rounded component and the roller cooperate with the groove to define the detent position. The rounded component can be a metallic ball in a particularly preferred embodiment of the present invention.

In a preferred embodiment of the present invention, it further comprises a spring that is supported by the retaining mechanism and configured to exert the force on the protrusion in the direction which is generally parallel to the first axis. The handle is disposed within a depression formed in the first part of the cowl when the handle is in the second position in a preferred embodiment of the present invention. The first part of the cowl assembly can be a lower cowl and the second part of the cowl assembly can be an upper cowl.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
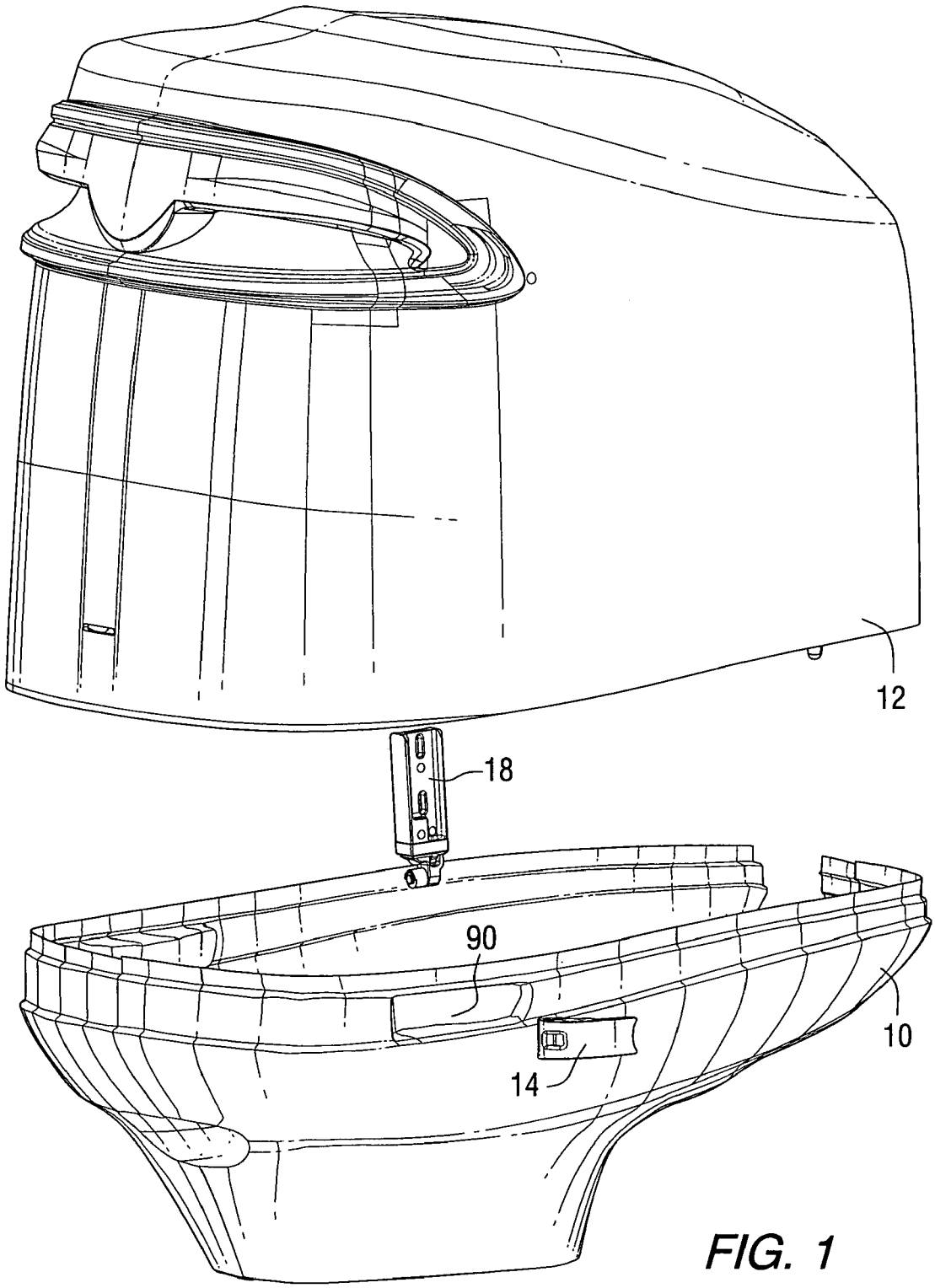
FIG. 1 is an exploded isometric view of a cowl assembly incorporating the present invention.

Throughout the description of the preferred embodiment of the present invention, like components will be identified by like reference numerals.

FIG. 1 is an exploded isometric view of a cowl structure which comprises a first part 10, or lower cowl, and a second part 12, or upper cowl. A handle 14 is attachable to the first part cowl assembly 10 within a depression 90. A retaining mechanism 18 is attachable to the second part 12 of the cowl assembly.

Figure 2:
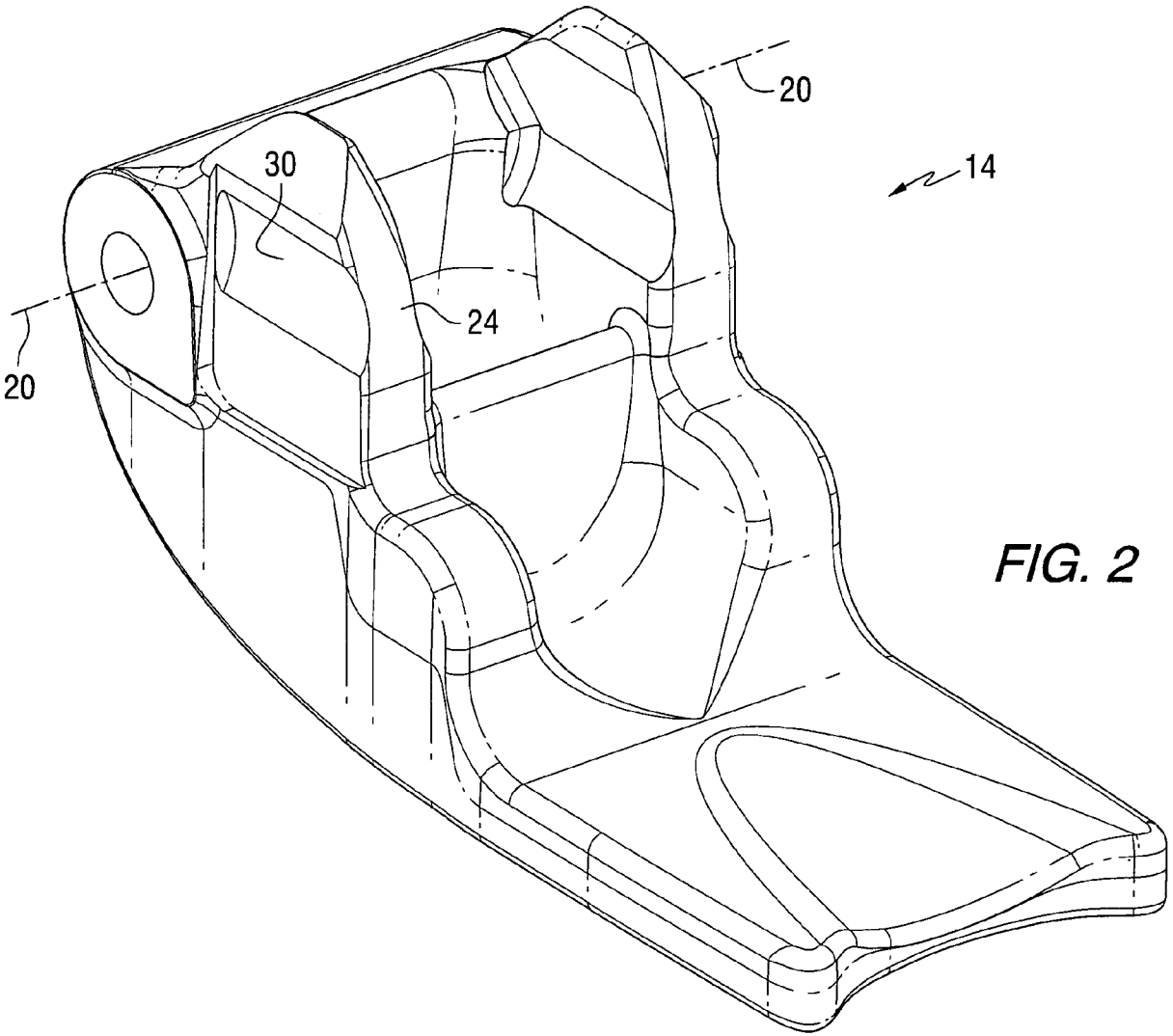
FIG. 2 is an isometric view of the handle of the present invention.

The handle 14, as illustrated in the isometric view of FIG. 2, is rotatable about a first axis 20 between first and second positions. The handle 14 has a protrusion 24 that extends from the handle. A groove 30 is formed in the handle.

Figure 3:
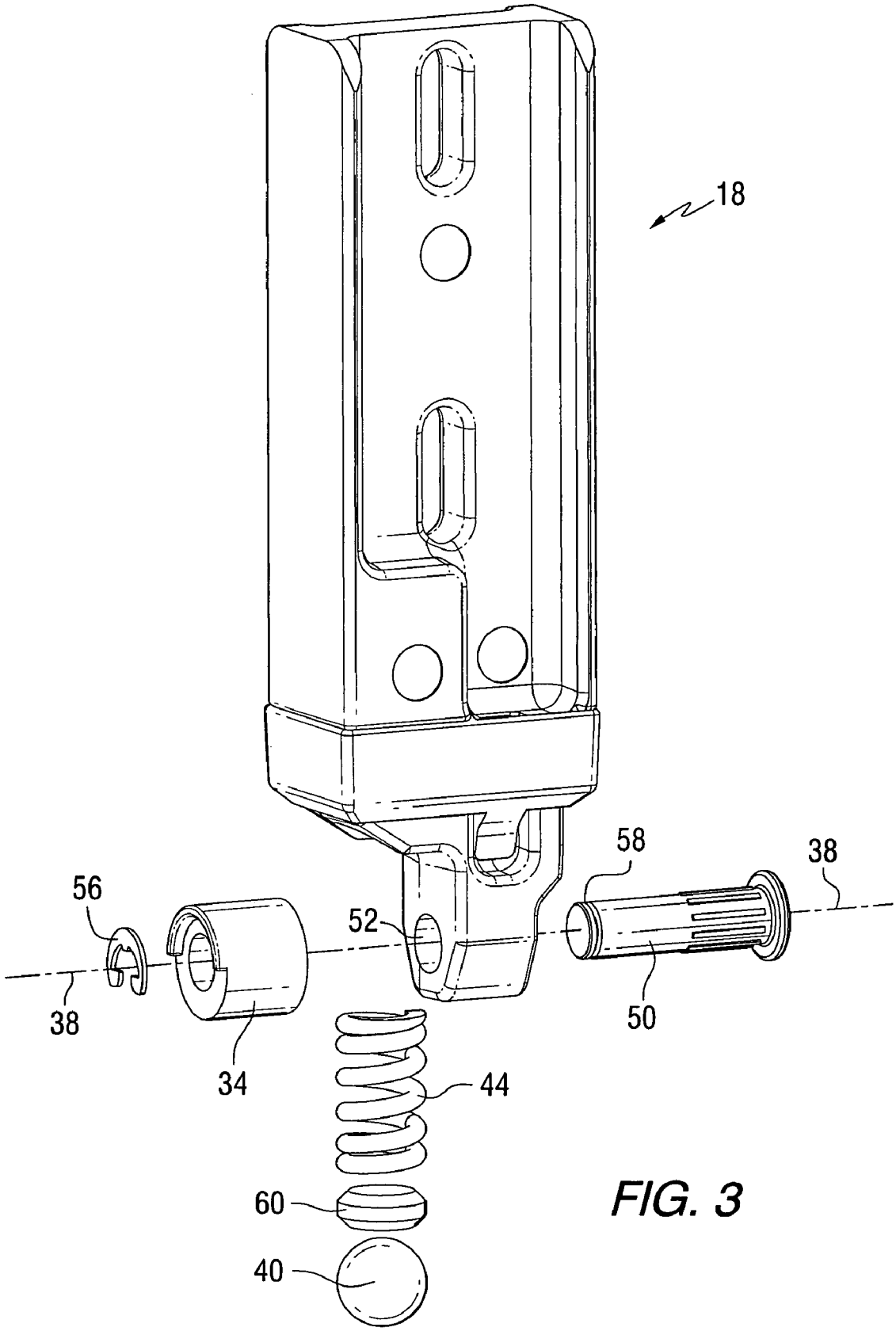
FIG. 3 is an exploded isometric view of a retaining mechanism of the present invention.

FIG. 3 is an exploded isometric view of the retaining mechanism 18. The retaining mechanism comprises first and second locking members. The first locking member comprises a roller 34 which is rotatably attached to the retaining mechanism 18 for rotation about a second axis 38. The second locking mechanism which is attached to the retaining mechanism 18 comprises a rounded component 40 which is shaped to be received in the groove 30 described above in conjunction with FIG. 2. In a preferred embodiment of the present invention, the rounded component 40 is a metallic ball. A spring 44 is supported by the retaining mechanism 18 and configured to exert a downward force on the protrusion 24 of the handle in a direction that is generally parallel to the first axis 20.

With continued reference to FIG. 3, the roller 34 is supported for rotation by a pin 50, which is inserted through a hole 52 in the retaining mechanism 18 and a snap ring 56 which is shaped to be attached to a groove 58 at the distal end of the pin 50. In addition, a shaped piece 60 is disposed between the spring 44 and the rounded component 40 in a preferred embodiment of the present invention.

Figure 4:
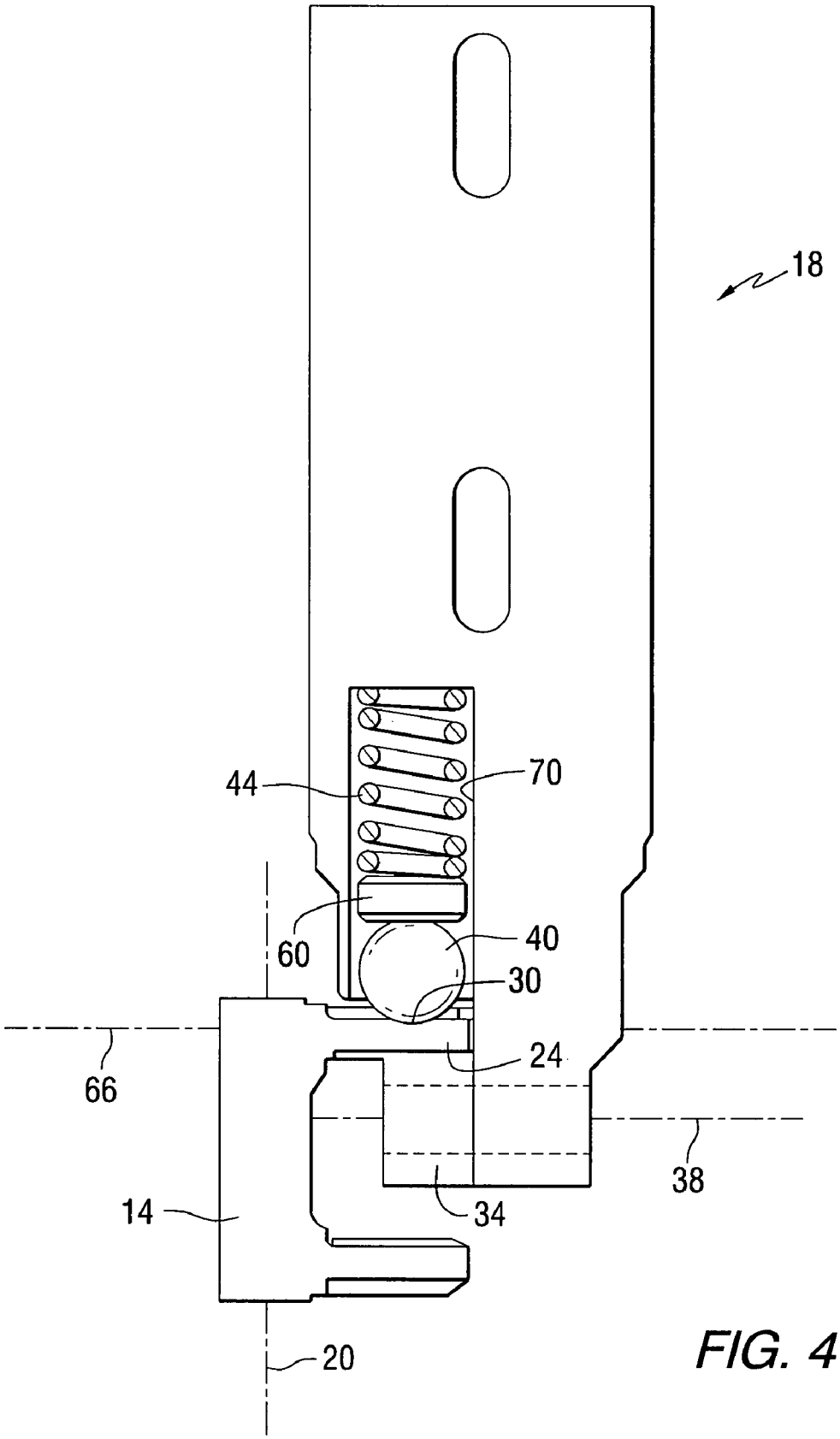
FIG. 4 is a side section view of the handle and retaining mechanism of the present invention associated together and placed in a latching configuration.

FIG. 4 is a side section view of the retaining mechanism 18 and the handle 14. It shows the protrusion 24 positioned between the rounded component 40, or metallic sphere, and the roller 34. In addition, the intermediate component 60 is shown in its normal position between the spring 44 and the metallic ball 40. When the protrusion 24 rotates about the first axis 20, with the handle 14, it moves in a plane 66. The roller 34 is rotatable about the second axis 38 as described above in conjunction with FIG. 3. When in the position shown in FIG. 4, the ball 40 is disposed within the groove 30 of the protrusion 24 and the spring 44 exerts a downward force on the protrusion 24 in a direction that is generally parallel to the first axis 20 and perpendicular to the plane 66. The spring 44, the shaped piece 60, and the metallic ball 40 are contained within a generally cylindrical opening 70 formed in the retaining mechanism 18.

Figure 5:
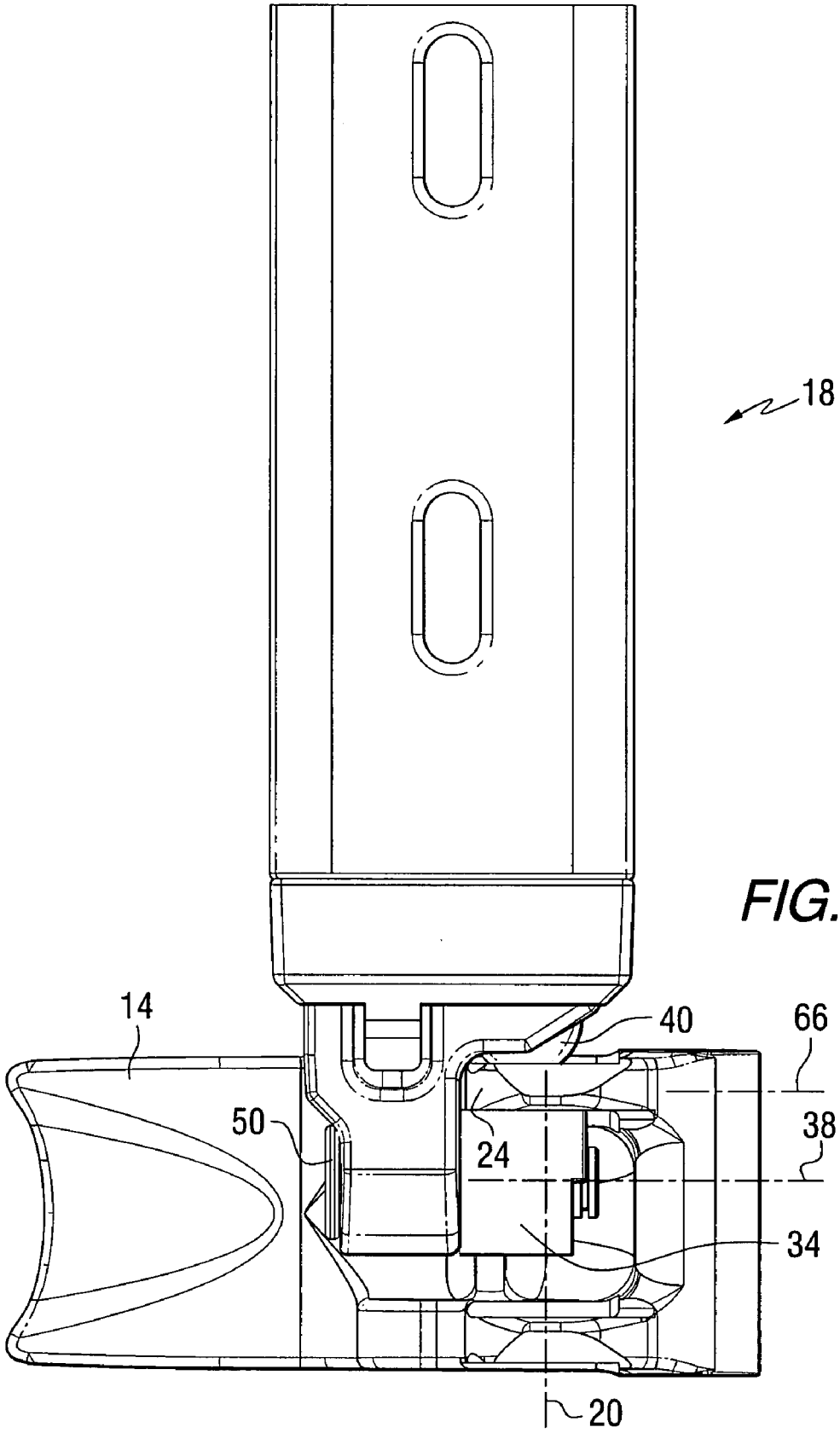
FIG. 5 is a side view showing the retaining mechanism and handle associated together.

FIG. 5 is a side view of the retaining mechanism 18 with its roller 34 which is rotatable about the second axis 38 and the metallic ball 40 which is urged in a downwardly direction by the spring 44 described above in conjunction with FIGS. 3 and 4. The handle 14 is rotated to dispose its protrusion 24 into the space between the roller 34 and the metallic ball 40. This rotation of the protrusion 24 and its groove is within plane 66. The groove 30 is not visible in FIG. 5 but is described above in conjunction with FIG. 2.

FIGS. 6A-6D show the relative movement of the handle 14 in relation to the retaining mechanism 18 with the handle shown at various stages of rotation about the first axis 20. In FIGS. 6A-6D, the bolt 80, or equivalent pivot mechanism, represents the position of the first axis 20 about which the handle 14 is rotatable.

Figure 6A:
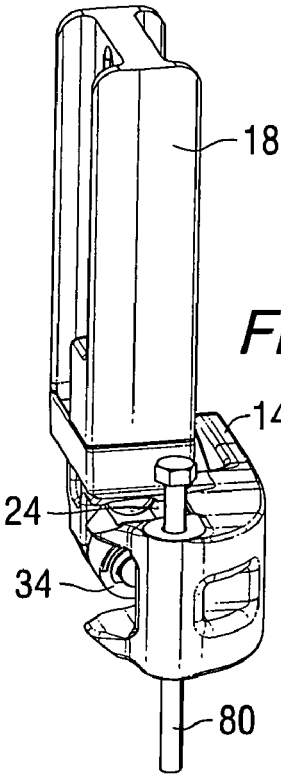
FIGS. 6A-6D show the present invention in various stages of latching.

In FIG. 6A, the handle 14 is in a locking, or second, position. The ball 40 (not visible in FIG. 6A) is forced downwardly into the groove 30 (not visible in FIG. 6A) by the spring to define a detent position that holds the handle 14 in its second or locking position. This enables the handle 14 to maintain the second position shown in FIG. 6A even though the first and second parts of the cowl assembly of the outboard motor are subjected to shock loads.

Figure 6B:
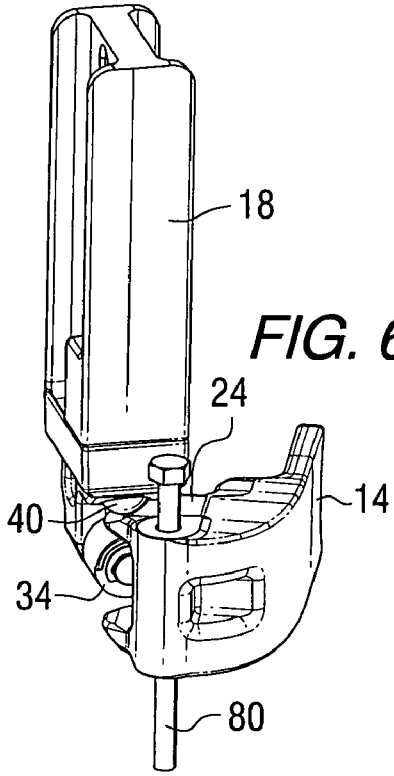

FIG. 6B shows the handle 14 rotated approximately twenty degrees about the first axis relative to its position in FIG. 6A. The ball 40 is partially moved out of the groove 30 (not shown in FIG. 6B) and the protrusion 24 is partially rotated out of the gap between the roller 34 and the ball 40.

Figure 6C:
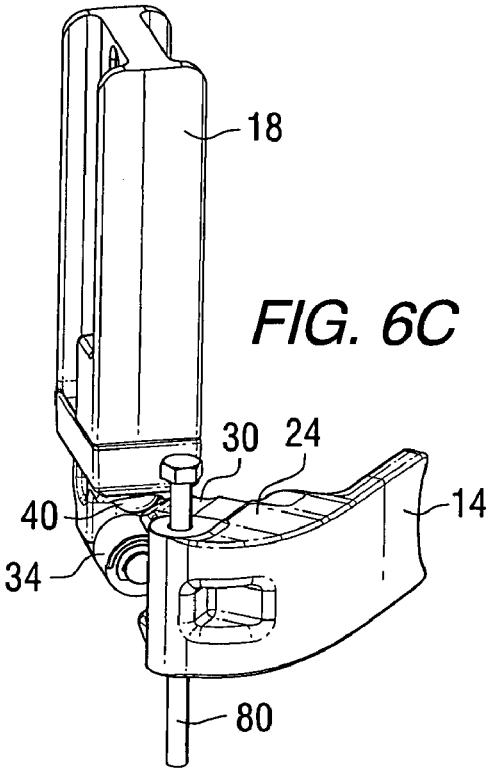

FIG. 6C shows the handle 14 rotated approximately forty degrees about the first axis from its position shown in FIG. 6A. The groove 30 and the metallic rounded component 40, or ball, are separated from each other and the protrusion 24 is moved out of its position between the ball 40 and the roller 34.

Figure 6D:
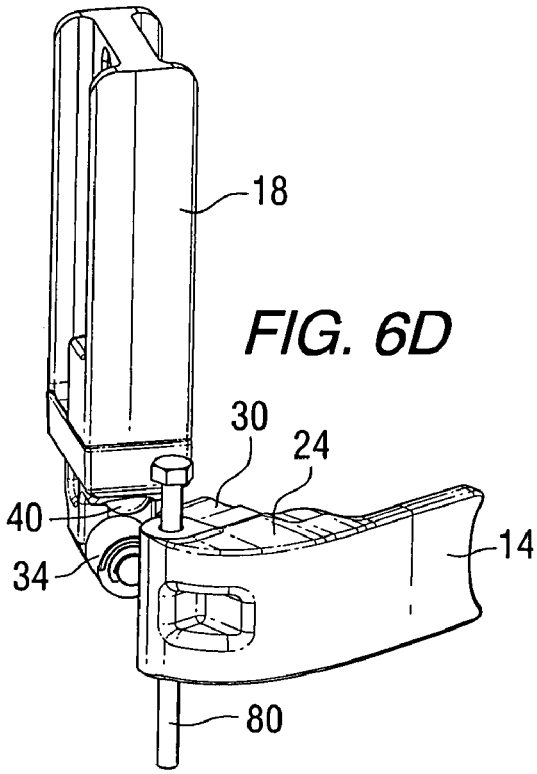

In FIG. 6D, the handle 14 is rotated about the first axis approximately sixty degrees from its position illustrated in FIG. 6A. The groove 30 is clearly visible and the metallic ball 40 is shown displaced from the groove 30. The protrusion 24, in which the groove 30 is formed, is completely removed from the space between the metallic ball 40 and the roller 34.

With continued reference to FIGS. 1-5 and 6A-6D, it can be seen that a preferred embodiment of the latch mechanism of the present invention comprises a handle 14 which is attachable to a first part 10 of a cowl assembly. The handle 14 is rotatable about a first axis 20 between first and second positions. The first position is illustrated in FIG. 6D and the second position is illustrated in FIG. 6A. The first position unlatches the first and second parts of the cowl assembly and the second position latches them to each other. The handle 14 has a protrusion 24 extending from the handle. The protrusion 24 is rotatable about the first axis 20 with the handle 14. A retaining mechanism 18 is attachable to the second part 12 of the cowl assembly. The protrusion 24 of the handle 14 is movable into contact with the retaining mechanism 18 in response to rotation of the protrusion 24 about the first axis 20 which is also represented by the bolt 80 in FIGS. 6A-6D. The retaining mechanism 18 is configured to exert a force on the protrusion 24 in a direction that is generally parallel to the first axis 20. The handle 14 and the retaining mechanism 18 are configured to define the second position, as shown in FIG. 6A, as a detent position of the handle 14. The second position (illustrated in FIG. 6A) is a locking position which retains the second part 12 of the cowl assembly in a fixed position attached to the first part 10 of the cowl assembly. A groove 30 is formed in the handle 14. The groove is movable within a first plane 66 in response to rotation of the handle 14 about the first axis 20. First and second locking members, 34 and 40, are attached to the retaining mechanism 18. The first locking member comprises a roller 34 which is rotatably attached to the retaining mechanism 18. The roller 34 is supported by the retaining mechanism 18 for rotation about a second axis 38 which is generally perpendicular to the first axis 20 and parallel to the first plane 66. The second locking mechanism 40 comprises a rounded component shaped to be received in the groove 30. The rounded component 40 and the roller 34 cooperate with the groove 30 to define the detent position. As described above, the rounded component 40 is a metallic ball in a particularly preferred embodiment of the present invention. The latch mechanism can further comprise a spring 44 which is supported by the retaining mechanism 18 and configured to exert the force on the protrusion 24 in a direction which is generally parallel to the first axis 20 when the handle is completely closed. The handle 14 is disposed within a depression 90 formed in the first part 10 of the cowl when then handle 14 is in the second position illustrated in FIG. 6A. The first part 10 of the cowl assembly is a lower cowl in a preferred embodiment of the present invention and the second part 12 of the cowl assembly is an upper cowl as illustrated in FIG. 1.

Although the present invention has been described with particular specificity and illustrated to show a preferred embodiment, it should be understood that alternative embodiments are also within its scope.

We claim:

1. A latch mechanism for a cowl, comprising:

a handle which is attachable to a first part of a cowl assembly, said handle being rotatable about a first axis between first and second positions, said handle having a protrusion extending from said handle and rotatable about said first axis; and a retaining mechanism which is attachable to a second part of said cowl assembly, said protrusion of said handle being movable into contact with said retaining mechanism in response to rotation of said protrusion about said first axis, said retaining mechanism being configured to exert a force on said protrusion, said handle and said retaining mechanism being configured to define said second position as a detent position of said handle, said second position being a locking position which retains said second part of said cowl assembly in a fixed position attached to said first part of said cowl assembly.

2. The latch mechanism of claim 1, further comprising:

a groove formed in said handle, said groove being movable within a first plane in response to rotation of said handle about said first axis.

3. The latch mechanism of claim 2, further comprising:

first and second locking members attached to said retaining mechanism.

4. The latch mechanism of claim 3, wherein:
said first locking member comprises a roller which is rotatably attached to said retaining mechanism.

5. The latch mechanism of claim 4, wherein:
said roller is rotatably attached to said retaining mechanism for rotation about a second axis which is generally perpendicular to said first axis and parallel to said first plane.

6. The latch mechanism of claim 5, wherein:
said second locking mechanism comprises a rounded component shaped to be received in said groove.

7. The latch mechanism of claim 6, wherein:
said rounded component and said roller cooperate with said groove to define said detent position.

8. The latch mechanism of claim 6, wherein:
said rounded component is a ball.

9. The latch mechanism of claim 1, further comprising:
a spring supported by said retaining mechanism and configured to exert said force on said protrusion.

10. The latch mechanism of claim 1, wherein:
said handle is disposed within a depression formed in said first part of said cowl assembly when said handle is in said second position.

11. The latch mechanism of claim 1, wherein:
said first part of said cowl assembly is a lower cowl; and
said second part of said cowl assembly is an upper cowl.

12. A latch mechanism for a cowl, comprising:
a handle which is attachable to a first part of a cowl assembly, said handle being rotatable about a first axis between first and second positions, said handle having a protrusion extending from said handle and rotatable about said first axis, said handle being disposed within a depression formed in said first part of said cowl assembly when said handle is in said second position;
a groove formed in said handle, said groove being movable within a first plane in response to rotation of said handle about said first axis; and
a retaining mechanism which is attachable to a second part of said cowl assembly, said protrusion of said handle being movable into contact with said retaining mechanism in response to rotation of said protrusion about said first axis, said retaining mechanism being configured to exert a force on said protrusion, said handle and said retaining mechanism being configured to define said second position as a detent position of said handle, said second position being a locking position which retains said second part of said cowl assembly in a fixed position attached to said first part of said cowl assembly.

13. The latch mechanism of claim 12, wherein:
said first part of said cowl assembly is a lower cowl; and
said second part of said cowl assembly is an upper cowl.

14. The latch mechanism of claim 13, further comprising:
first and second locking members attached to said retaining mechanism.

15. The latch mechanism of claim 14, wherein:
said first locking member comprises a roller which is rotatably attached to said retaining mechanism; and
said second locking mechanism comprises a rounded component shaped to be received in said groove.

16. The latch mechanism of claim 15, wherein:
said rounded component and said roller cooperate with said groove to define said detent position.

17. The latch mechanism of claim 16, wherein:
said rounded component is a ball.

18. The latch mechanism of claim 17, further comprising:
a spring supported by said retaining mechanism and configured to exert said force on said protrusion.

19. A latch mechanism for a cowl, comprising:
a handle which is attachable to a first part of a cowl assembly, said handle being rotatable about a first axis between first and second positions, said handle having a protrusion extending from said handle and rotatable about said first axis;
a retaining mechanism which is attachable to a second part of said cowl assembly, said protrusion of said handle being movable into contact with said retaining mechanism in response to rotation of said protrusion about said first axis, said retaining mechanism being configured to exert a force on said protrusion in a direction which is generally parallel to said first axis, said handle and said retaining mechanism being configured to define said second position as a detent position of said handle, said second position being a locking position which retains said second part of said cowl assembly in a fixed position attached to said first part of said cowl assembly;
a groove formed in said protrusion, said groove being movable within a first plane in response to rotation of said handle about said first axis; and
first and second locking members attached to said retaining mechanism, said first locking member comprising a roller which is rotatably attached to said retaining mechanism, said second locking mechanism comprising a rounded component shaped to be received in said groove.

20. The latch mechanism of claim 19, further comprising:
a spring supported by said retaining mechanism and configured to exert said force on said protrusion in said direction which is generally parallel to said first axis, said rounded component and said roller cooperating with said groove to define said detent position.

21. The latch mechanism of claim 20, wherein:
said rounded component is a metallic ball.

22. The latch mechanism of claim 21, wherein:
said first part of said cowl assembly is a lower cowl and said second part of said cowl assembly is an upper cowl, said handle being disposed within a depression formed in said lower cowl when said handle is in said second position.

* * * * *